US005644130A

United States Patent [19]

Raatz

[11] Patent Number: 5,644,130

[45] Date of Patent: Jul. 1, 1997

[54] MULTI-GAS CATHODE ION SURGE

[75] Inventor: James E. Raatz, Middleton, Wis.

[73] Assignee: National Electrostatics Corp., Middleton, Wis.

[21] Appl. No.: 619,850

[22] Filed: Mar. 20, 1996

[51] Int. Cl.[6] ..... H01J 49/04

[52] U.S. Cl. ..... 250/288; 250/423 R

[58] Field of Search ..... 250/288, 288 A, 250/281, 282, 285, 423 R

[56] References Cited

U.S. PATENT DOCUMENTS

| | | | |
|---|---|---|---|
| 4,076,982 | 2/1978 | Ritter et al. | 250/288 |
| 4,405,860 | 9/1983 | Brunnee et al. | 250/288 |
| 5,272,337 | 12/1993 | Thompson et al. | 250/288 |
| 5,300,785 | 4/1994 | Aiken | 250/423 R |

OTHER PUBLICATIONS

"The new LLNL AMS sample changer," Roberts et al., *Nuclear Instruments and Methods in Physics Research B* 92 (1994) 111–114 North–Holland.

"The LLNL ion source–past, present and future," Proctor et al., *Nuclear Instruments and Methods in Physics Research B*52 (1990) 334–337 North–Holland.

"Gas handling systems for radiocarbon dating by AMS," Ramsey et al., *Nuclear Instruments and Methods in Physics Research B* 92 (1994) 105–110 North–Holland.

"A gaseous ion source for routine AMS radiocarbon dating," Bronk et al., *Nuclear Instruments and Methods in Physics Research B* 52 (1990) 322–326 North–Holland.

"A $CO_2$ Negative Ion Source For $^{14}C$ Dating," Middleton et al., *Nuclear Instruments and Methods in Physics Research B*43 (1989) 231–239 North–Holland, Amsterdam.

*Primary Examiner*—Kiet T. Nguyen

*Attorney, Agent, or Firm*—Lathrop & Clark

[57] ABSTRACT

An ion source employs a self-contained sample containment valve which serves to store, transport and dispense a gas sample from which a negative ion beam is generated. The valve is loaded with a sample of carbon dioxide gas by cryo-pumping carbon dioxide gas into a finger which is refrigerated with liquid nitrogen and which is connected to the stored volume of the valve. A sample contained in the gas containment valve is combined with a total of forty sample containment valves on a carousel which is mounted adjacent to the cathode of a negative ion source of a tandem accelerator facility within a vacuum chamber. When a particular sample containment valve is aligned with the cathode an actuator causes the sample containment valve to move forward a short distance positioning the valve to dispense gas to generate a negative carbon ion beam. When changing the samples contained on the carousel, the ion source must be shut off from the vacuum chamber. This is accomplished by interposing a gate valve. In order to minimize the distance which the sample containment valves must move to enter into engagement with the ion source, the entire sample vacuum chamber and drive mechanism is slidably mounted with respect to the ion source. A stainless steel bellows allows the retracting motion of the sample vacuum chamber. The gate valve provides passage for the ion source to enter or leave the sample vacuum chamber.

24 Claims, 6 Drawing Sheets

MULTI-GAS CATHODE ION SURGE

FIELD OF THE INVENTION

The present invention relates to ion sources in general and to apparatus for injecting a material sample into an ion source for generating an ion beam from the injected sample. More particularly, the invention relates to apparatus for injecting carbon dioxide into an ion source for the purpose of generating a carbon ion beam from which the relative abundance of $^{14}C$ with respect to $^{13}C$ and $^{12}C$ can be determined.

BACKGROUND OF THE INVENTION

Radioactive $^{14}C$ is constantly being generated through the interaction of cosmic rays with the upper atmosphere. This radioactive carbon, in the form of $CO_2$, enters the "carbon cycle" as plants utilize $CO_2$ in the production of food. $^{14}C$ is constantly decaying with a half-life of approximately 5730 years. In the atmosphere, where $^{14}C$ is constantly replenished, there is a constant ratio between the amount of $^{14}C$ and the other isotopes of carbon. When a living organism dies, the organic matter which forms the organism no longer interacts with the atmosphere. Thus, over time, as the radioactive $C^{14}$ decays, the ratio between $^{14}C$ and the non-radioactive isotopes of carbon changes and this change in the ratio can be used to determine how long an assemblage of organic material has been dead.

Monitoring the radioactive decay of $^{14}C$ in a sample of dead organic matter allows the calculation of the amount of time which has passed since the plant or animal from which the organic matter is derived died.

Although monitoring the decay of $^{14}C$ is an effective method of dating organic matter, the process has several limitations which can render the process inaccurate or impractical. Because of the relatively low radioactivity—less than fourteen disintegrations per minute per gram of carbon—of organic derived carbon, sample sizes on the order of a gram are required for the conventional process. Another limitation is that the samples are destroyed during the dating process. The smaller the sample the greater the amount of time required to determine the amount of $^{14}C$ present in the test sample by monitoring radioactive disintegrations. The older the sample the more sensitive the age-determination is to a precise measurement of the $^{14}C$ present. Many ancient artifacts are of such value that only extremely small samples can be submitted for destruction in the $^{14}C$ dating process.

The foregoing physical and practical limitations mean that $^{14}C$ dating by conventional methods is of limited practical value.

To overcome these problems a mass spectrometer can be used to determine the amount of $^{14}C$ present in a sample, directly. Because all the $^{14}C$ atoms in a sample are available for direct detection, the ratio between $^{14}C$ and the other isotopes in a carbon sample can be rapidly determined for extremely small samples with a high degree of precision.

There are a number of practical problems associated with the use of a mass spectrometer to determine the isotope ratios between $^{14}C$ and the other isotopes of carbon. The first step of the process whereby a mass spectrometer may be used to determine the relative abundance of $^{14}C$ in a sample is the creation of a negative ion beam containing carbon ions from the sample. Once a negative ion beam of carbon atoms has been produced a tandem accelerator can be used to separate carbon ions from all other molecular isomers. The isolated carbon ions are then analyzed by use of a mass-spectrometer which measures the amount of $^{14}C$ present in the sample relative to the other isotopes of carbon.

The tandem accelerator, the ion beam processing equipment and the ion detectors make up an apparatus of such cost and size that there exist relatively few facilities housing them.

On the other hand, the number of scientists, particularly archaeologists, for whom $^{14}C$ is a critical part of the work they do, is relatively large. Each article for which it is desired to determine a $^{14}C$ date must be separately sampled and tested. The sample sizes available are typically on the order of thousandths of a gram. The small sample sizes are in part due to the historical value of the artifact, for example the Dead Sea Scrolls. Small sample size can also be the result of the attempt to date a non-organic artifact from a small amount of organic material found in association with the artifact. For example, the dating of successive layers of soil in an archaeological dig by the dating of charcoal residue from campfires to thereby establish a date for all the artifacts buried in each layer of soil at the dig.

Thus, there is an ever increasing demand for a more accurate processing of more samples. In order for a sample's age to be determined by mass spectrometry $^{14}C$ dating, it must be converted to a beam of negative ions. This is typically done by converting the sample to carbon dioxide gas. The gas is absorbed onto a titanium cathode where a cesium ion beam interacting with the carbon dioxide absorbed on the surface of the titanium generates negative carbon ions. An alternative approach is to form graphite by depositing carbon from the carbon dioxide gas onto a substrate and bombarding the graphite with cesium ions. As the process is currently practiced, the scientist or the laboratory takes a sample of carbon-containing material and converts it through combustion to carbon dioxide gas, which is sealed in a glass bottle. The samples, in the form of carbon dioxide gas, are then sent to a facility having a properly equipped tandem accelerator where the $^{14}C$ analysis is performed.

$^{14}C$ dating, like most data gathering procedures, is subject to technique induced errors. In the past, the samples of carbon dioxide have been withdrawn from the ampule into a transfer chamber or syringe and then transferred by way of a tube to the cathode of the ionization chamber. Contamination from the air or with organic matter will result in an understatement of the age of the sample being tested.

The processes whereby $^{14}C$ samples are dated with a mass spectrometer are relatively new. The normal progress in improving the reliability of a new scientific procedure is for the individual researchers to become intimately involved in performing and developing standard techniques by which a given analysis is performed. This approach is not practical in mass spectrometry $^{14}C$ dating because of the relatively small number of facilities capable of performing the test. Current practice has evolved to the point where multiple samples are sent to different $^{14}C$ mass spectrometry analysis facilities to improve the perceived reliability of the numbers.

While $^{14}C$ dating may seem of mere academic or historical interest, its use, in combination with modem genetic testing, can play a key role in setting environmental policy. Questions of whether an animal population is losing genetic diversity can be solved with reference to museum collections of specimens whose accurate dating by $^{14}C$, together with genetic material recovered from preserved pelts and animal specimens, can provide data on historic change or lack thereof regarding genetic diversity in a studied population.

Recently, for example, a controversy has arisen as to whether the red wolf is a distinct species of animal or whether it is merely a cross between coyotes and grey wolves. Light has been shed on this question through research and age dating of furs contained in the Smithsonian Institution's fur collection.

What is needed is a way of reducing or eliminating technique-induced errors between the generation of a carbon dioxide gas sample and its introduction into the ion source utilized in the mass spectrometric determination of the $^{14}C$ dating process.

SUMMARY OF THE INVENTION

The ion source of this invention employs a self-contained sample containment valve which serves to store, transport and dispense a gas sample from which a negative ion beam is generated. The gas containment valve is loaded with a sample of carbon dioxide gas by cryo-pumping carbon dioxide gas into a finger which is refrigerated with liquid nitrogen and which is connected to the stored volume of the valve. The valve employs a stainless steel valve stem which rests on a copper seat. The valve seat is biased open by a pair of Belleville Springs and is biased closed by approximately twenty-five Belleville springs which are compressed and released by a threaded control rod. Once the $CO_2$ sample is cryo-pumped within the storage volume of the valve, the valve is closed and back-filled with argon. The valve may then be shipped to a tandem accelerator facility for the generation of a negative ion beam of carbon from which it is possible to determine the ratio of $^{14}C$ to the isotopes of $^{12}C$ and $^{13}C$ which determines the radiocarbon age of the sample.

When the sample is received at the tandem accelerator facility it is combined with a total of forty sample containment valves on a carousel which is mounted adjacent to the cathode of a negative ion source within a vacuum chamber. Each sample containment valve is spring-loaded and an individual sample containment valve may be rotated into alignment with a cathode of a negative ion source. When a particular sample containment valve is aligned with the cathode heat sink shield, an actuator causes the sample containment valve to move forward a short distance positioning the valve to dispense gas so as to generate a negative carbon ion beam.

The valve contains a titanium cathode which is heated by a cesium ion beam. When an actuator rotates the control rod allowing the copper seat to move off the valve stem, a flow of carbon dioxide gas is initiated. The carbon dioxide gas is absorbed on the titanium cathode where the bombardment with negative cesium ions generates oxygen and carbon negative ions. When a different sample is desired, either as a control or as another sample, the actuator closes the valve incorporated in the sample containment valve and retracts the valve from the ion source heat shield whereupon rotation of the carousel brings another sample into alignment for movement by the actuator into engagement with the ion source.

When it is desired to change the samples contained on the carousel, the ion source must be shut off from the vacuum chamber containing the samples so the sample chamber may be opened without flooding the tandem accelerator with atmospheric gases. This is accomplished by interposing a gate valve between the ion source and the sample containment vacuum chamber. In order to minimize the distance which the sample containment valves must move to enter into engagement with the ion source, the entire sample vacuum chamber and drive mechanism is slidably mounted with respect to the ion source and the accelerator. A stainless steel bellows allows the retracting motion of the sample vacuum chamber. A gate valve mounted on the vacuum chamber separates the vacuum chamber from the ion source when the vacuum chamber is retracted. When the vacuum chamber is evacuated and the gate valve is open, movement of the vacuum chamber towards the source results in positioning the source through the gate valve opening and closely spaced from the sample containment valves positioned on the carousel within the vacuum chamber.

It is an object of the present invention to provide a receiver for storing, transporting and dispensing carbon dioxide gas used in carbon dating.

It is another object of the present invention to provide a valve which allows controlled release of gas at very low pressures.

It is a further object of the present invention to provide a multiplicity of gas samples which may be individually selected and supplied to an ion source.

It is a still further object of the present invention to provide a gate valve for sealing a sample chamber from an ion source without blocking access to the ion source when the valve is open.

It is a still further object of the present invention to provide an apparatus for more accurately and reliably dispensing carbon dioxide samples into the ion source of a tandem accelerator.

It is yet another object of the present invention to provide an apparatus for more accurately carbon dating a sample of carbon.

It is a yet further object of the present invention to improve the repeatability and lower the cost of processing a carbon dioxide gas sample to determine the atomic abundance of $^{14}C$ with respect to the other naturally occurring isotopes of carbon.

Further objects, features and advantages of the invention will be apparent from the following detailed description when taken in conjunction with the accompanying drawings.

DESCRIPTION OF THE PREFERRED EMBODIMENT

Figure 1:
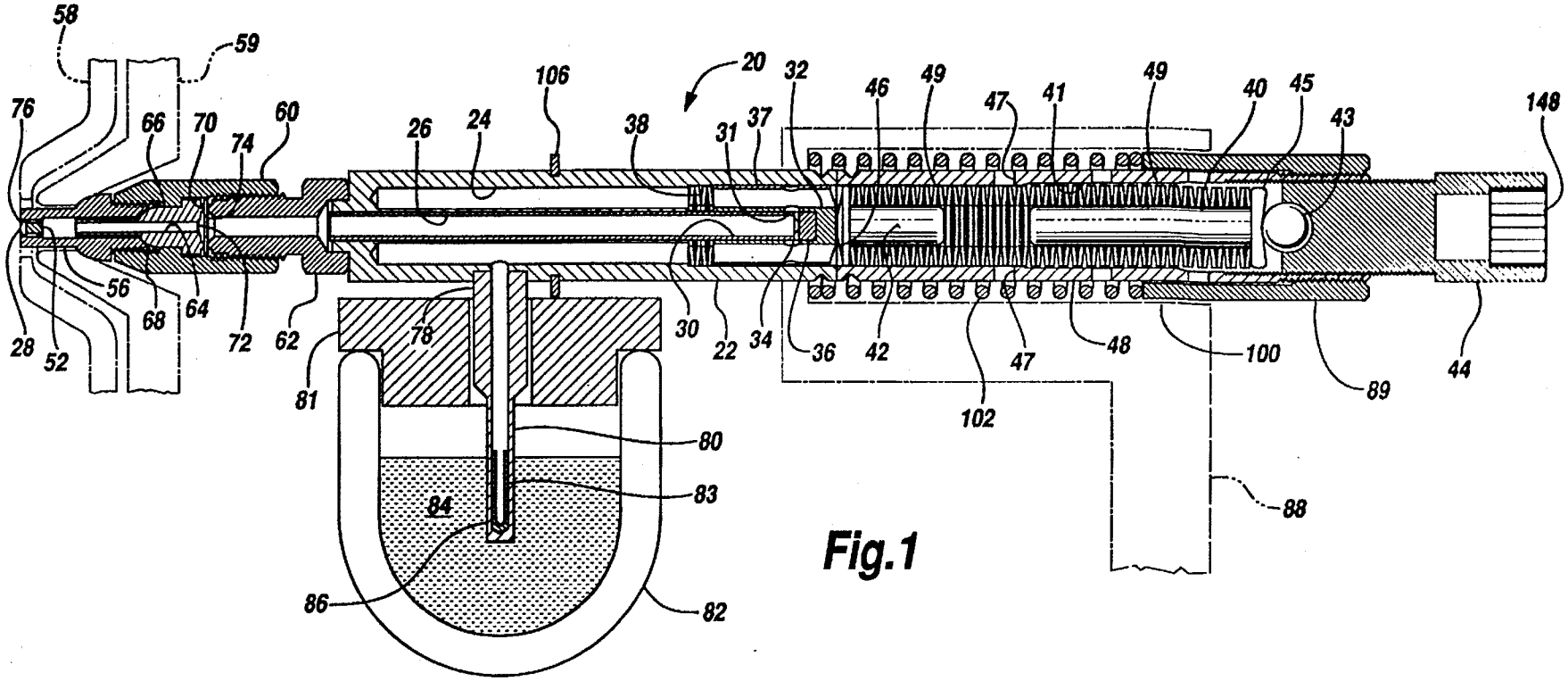
FIG. 1 is a side elevational cross-sectional view of the sample containment valve of this invention.
Figure 2:
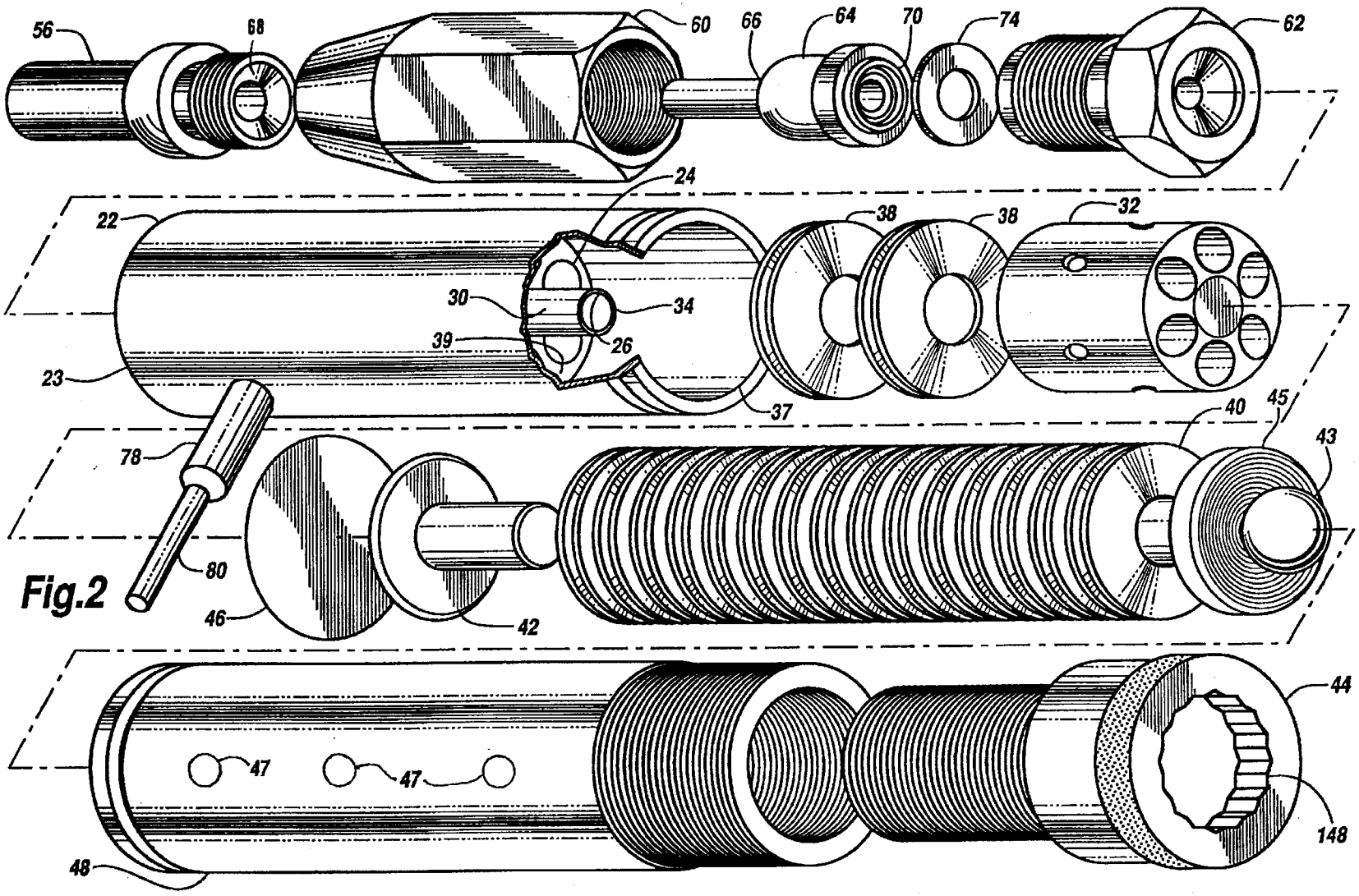
FIG. 2 is an exploded isometric view of portions of the sample containment valve of FIG. 1.
Figure 3:
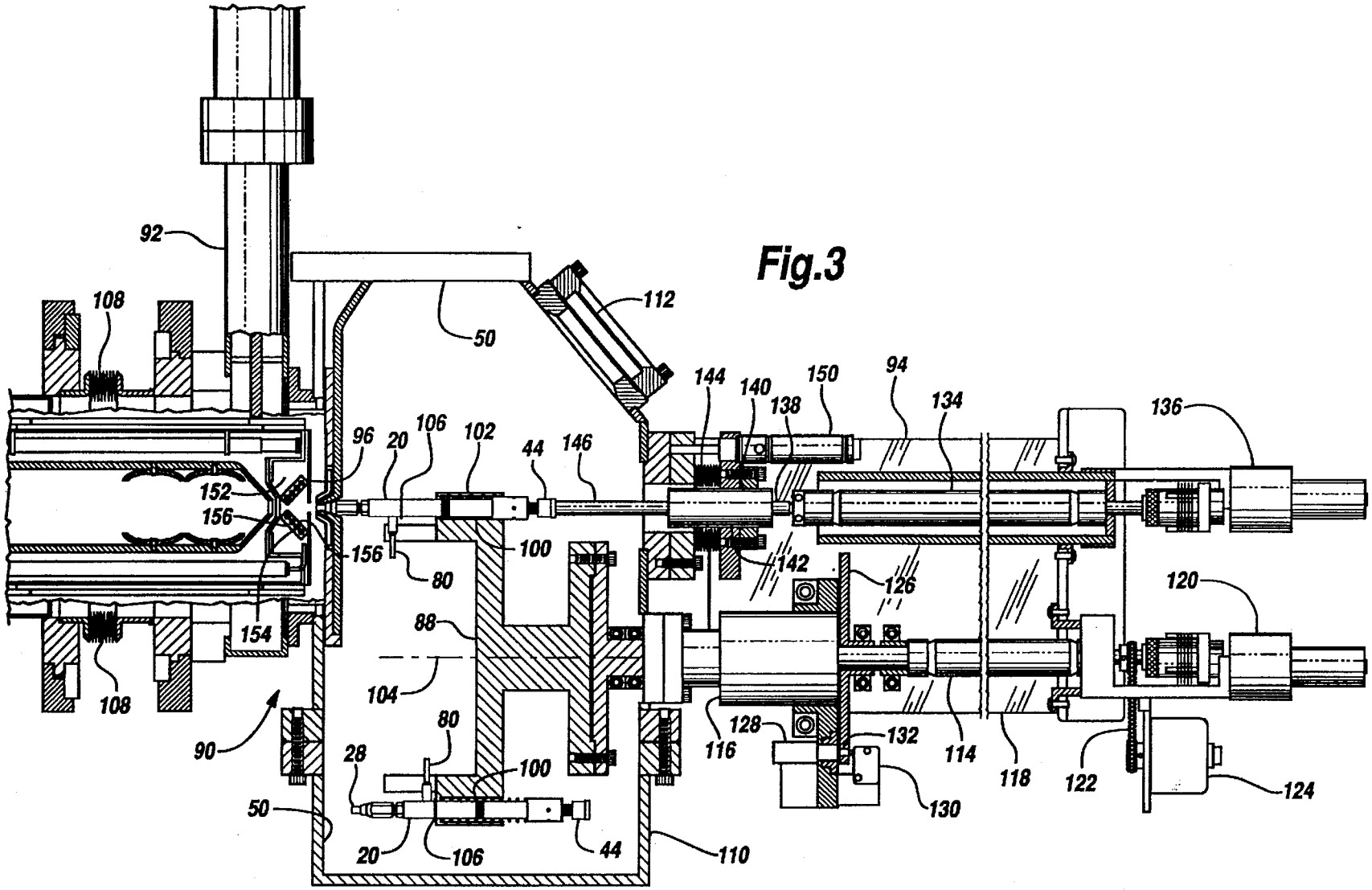
FIG. 3 is a side elevational cross-sectional view of a sample supply carousel and the mechanism for driving the carousel and positioning, opening and closing the sample containment valve of this invention.

Referring more particularly to FIGS. 1–7, wherein like numbers refer to similar parts, a sample containment valve 20 is shown in FIGS. 1 and 2. The containment valve 20 serves as a container for remote preparation of test samples to be processed in a tandem accelerator facility. Multiple containment valves 20 are mounted in a multiposition carousel 88 for exposure to an ion source 90 as shown in FIG. 3. The sample container 20 has a cylindrical valve body 22 with a forward portion 23 which is welded to a rear portion 48. The valve body 22 defines an internal gas storage volume 24 which is sealed from an axial passageway 26 which leads to a forward gas exhaust 28. The passageway 26 is formed by a stainless steel tube or valve-stem 30 which extends through the valve body 22 and into a valve-seat element 32 to engage with a copper seat 36 to form a valve 31.

The valve-stem 30 has a sealing end 34 which is radiused to ten thousandths of an inch and is polished with diamond paste. The valve-seat element 32 is a cylindrical part which has an array of axially extending cylindrical holes formed therein. The copper insert 36 is connected to the valve-seat 32 and forms a part thereof. The forward portion 23 of the valve body 22 has a rearwardly opening cylindrical cavity 37 which receives the valve-seat element 32 so that the sealing end 34 of the valve-stem 30 extends into the valve seat element 32 and seats against the copper insert 36. The copper insert 36 is slightly deformed by the valve stem lip when the valve is first closed leaving an annular depression about five thousands of a inch deep in a face of the copper insert 36. As the stem is retracted from engagement with the copper insert, the flow volume can be controlled in small increments.

The valve-seat 32 element is slidably mounted within the valve body 22. Two pair of Belleville springs 38 are positioned around the valve stem 30 and acts between a rearwardly facing surface 39 of the valve body forward portion 23 and the valve-seat element 32. The valve seat copper insert 36 is biased axially away from the valve-stem 30 by the pairs of Belleville springs 38 and is biased axially towards the valve-stem 30 by approximately thirty pairs of similar Belleville springs 40 which are disposed within a cylindrical cavity 41 formed in the rear portion 48 of the valve body 22. The cylindrical cavity 41 is vented by vents 47. The rear portion Belleville springs 40 are positioned between a slidable plunger 42 and a rearwardly extending valve handle 44. The handle 44 is threaded for axial movement with respect to the rear portion 48 of the valve body.

As shown in FIG. 1, a metal sphere 43 is positioned in a conical recess defined by portions of the valve handle 44 and engages a spring guide 45. The Spring guide 45 holds the Belleville Springs 40 aligned thereby reducing wear between the springs 40 and the walls 49 of the cavity 41. The walls 49 are relieved to further prevent wear between the springs 40 and the walls 49 of the cavity 41. The sphere 43 is positioned such that rotation of the handle causes the sphere to bear on the guide 45 thus compressing the Belleville springs 40.

The number of Belleville springs 40 positioned in engaging the plunger 42 is fifteen times the number of Belleville Spring 38 engaging the valve seat 32. The spring constant of the Belleville Springs 38, 40 is the same. This means the valve handle 44 moves the ball 43 fifteen times as much as the plunger moves in response to rotation of the valve handle 44. The valve handle 44 has forty threads per inch which also produces mechanical advantage. Thus the arrangement of the Belleville Spring creates great mechanical advantage which facilitates moving the valve seat 32 by very small increments which produces a precision low volumetric flow throttling valve 31. For example, if the combined spring constant of the Bellevile springs 40 is one half the combined spring constant of the Belleville springs 38, a mechanical advantage of two results.

A vacuum tight diaphragm 46 is positioned between the forward portion 23 and the rear portion 48 of the valve housing. The diaphragm 46 is a thin flexible sheet of stainless steel which extends across the valve-seat element 32 and which is engaged by the plunger 42. The diaphragm 46 is welded to the valve body 22 and separates the gas storage volume 24 from the rear portion 48 of the valve body 22. The plunger 42 thus acts through the diaphragm 46 on the seat element 32. The diaphragm isolates the gas within the forward portion 23 of the housing from the rear portion of the housing.

The containment valve 20 is used to hold a sample of carbon dioxide gas for injection into a ion source in order to generate a beam of negative carbon ions. The ions generated are for injection into a tandem accelerator where the carbon ions are accelerated and subjected to a stripping process wherein molecular isomers of the carbon isotopes are removed. The relative abundance of $C^{14}$ in a sample is then determined relative to the stable isotopes of carbon with a mass-spectrometer.

Figure 4:
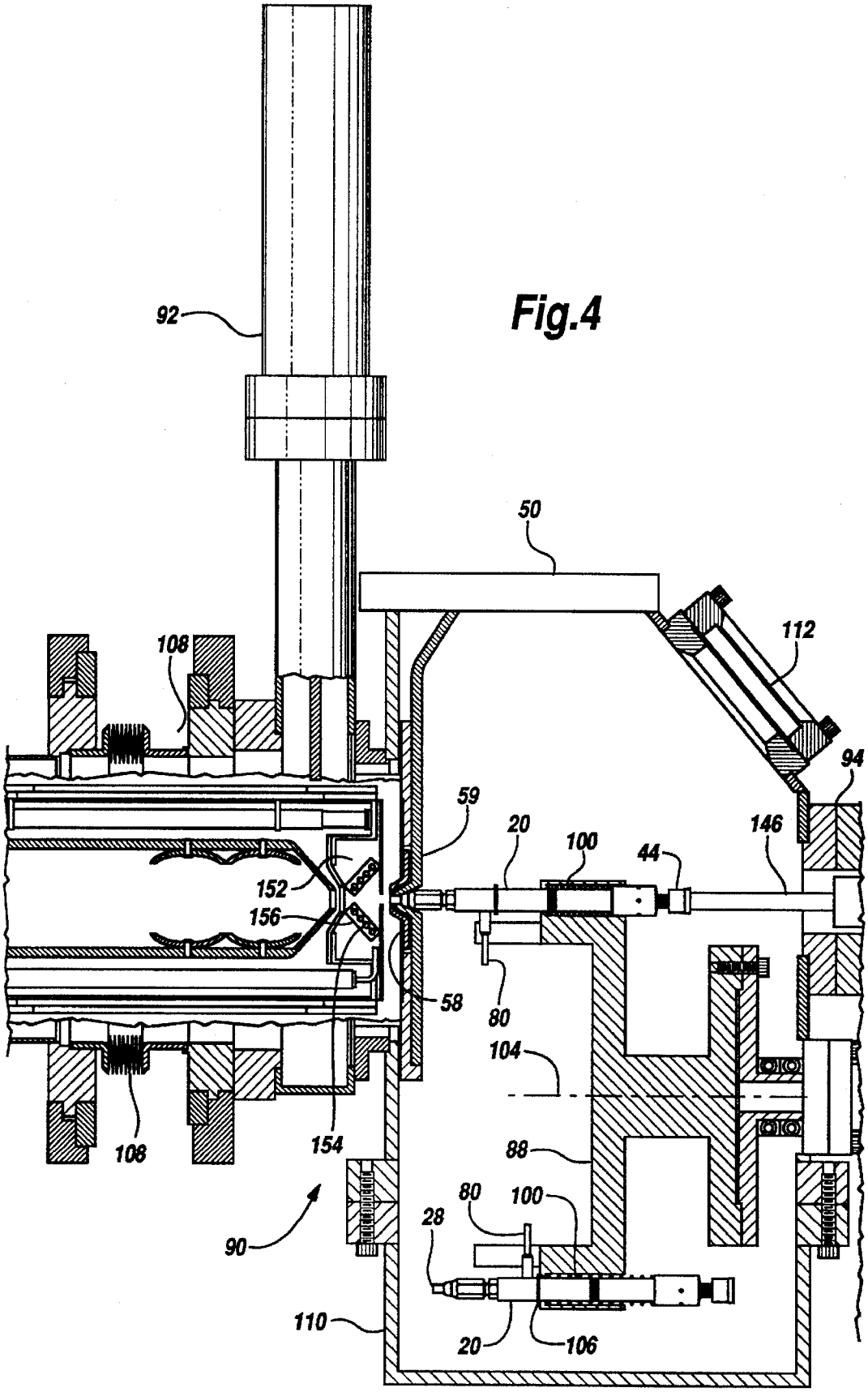
FIG. 4 is an enlarged fragmentary view of the sample carousel and sample vacuum container of FIG. 3 shown with the sample positioned adjacent the ion source.
Figure 5:
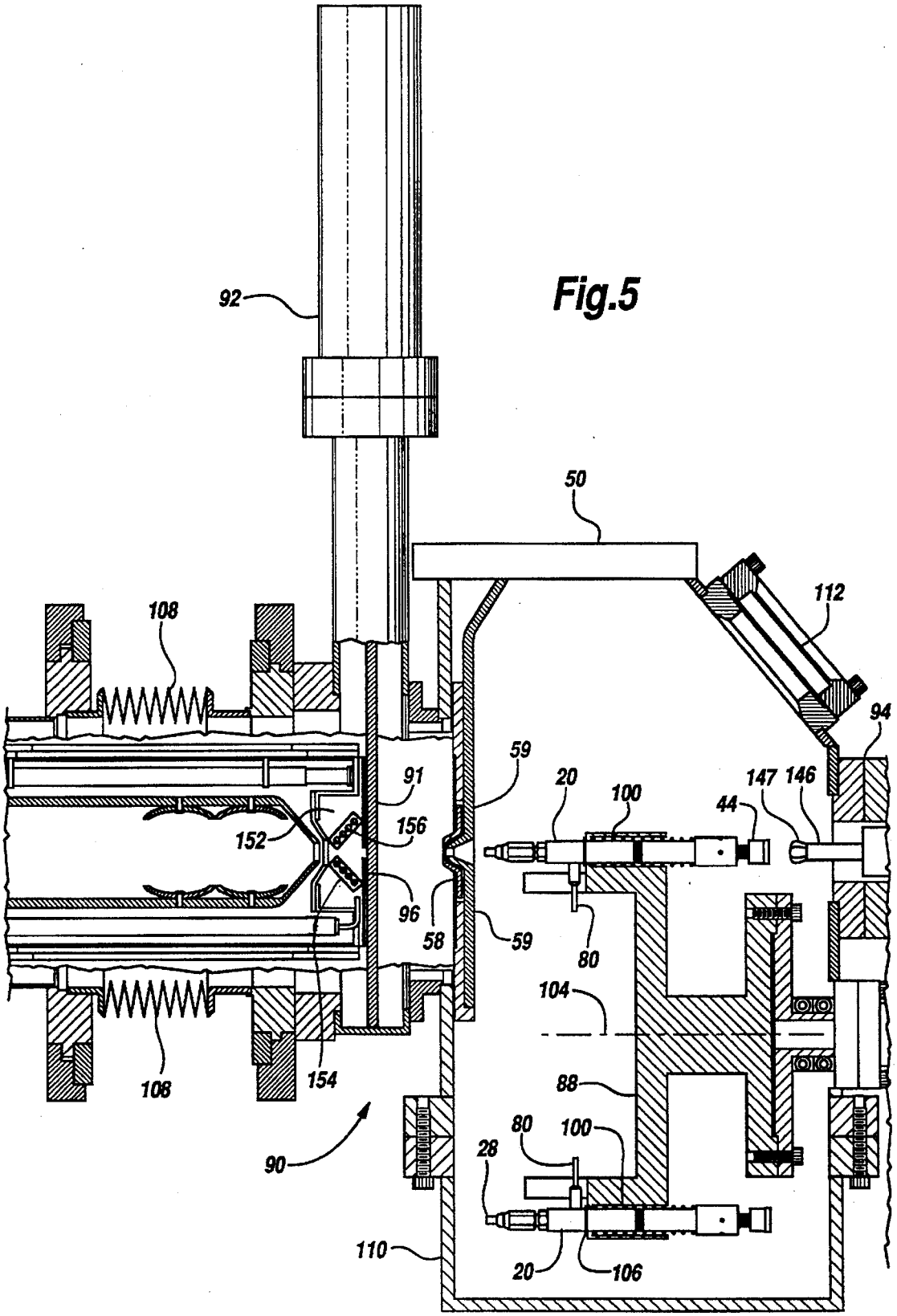
FIG. 5 is an enlarged fragmentary view of the apparatus of FIG. 4 with the ion sample vacuum chamber retracted from the ion source and sealed from the ion source by a gate valve.

The containment valve 20 serves three functions. It receives and stores a portion of carbon dioxide gas to be carbon dated, thus making the sample ready to ship and store. The containment valve 20 also makes the gas sample available for analysis within a sample vacuum chamber 50, as shown in FIGS. 3–5. In addition, the containment valve 20 meters the amount of gas which is supplied to the ion source 90 for producing the negative carbon ion beam. In current systems, all three functions are performed by separate apparatus. With existing techniques, carbon dioxide gas is collected and stored in glass ampules which are prepared by an experimenter and sent to a test laboratory for analysis. At the test lab the gas sample must be introduced into a manifold. The manifold must incorporate a valve for metering the gas to an ion generator. In processing the carbon dioxide samples for determining $C^{14}$ ratios, any contamination of the sample, either by modem carbon or ancient carbon, or just another sample, can significantly degrade the reliability of the results. The transfer of the sample gas from the glass ampules and the use of the same manifold for multiple samples provides opportunities for contamination of the sample.

In generating a negative ion beam from the sample of carbon dioxide gas a titanium cathode 52, shown in FIG. 1, is positioned to be impacted by the flow of carbon dioxide gas from the gas storage volume 24. The titanium cathode 52 acts as a getter, absorbing the gas sample. The interaction of a cesium ion beam generated by a coaxial ionizer 156 with the carbon dioxide gas absorbed on the titanium cathode 52 produces negative ions of carbon and oxygen. Because the titanium cathode 52 is contaminated by the gas sample, a separate titanium cathode 52 must be provided for each gas sample being tested. The sample containment valve 20 supplies the titanium cathode 52 in the form of a cylinder of titanium which has two flats to permit carbon dioxide to flow past to the cylinder's front surface and is mounted with an interference fit to an aluminum cathode holder 56. The aluminum cathode holder 56 provides heat-sinking capability to the titanium cathode 52 and the cathode holder 56 transfers heat to the cathode heat-sink 59. The cathode heat-shield 58 is mounted in front of the coaxial ionizer 156.

For manufacturing convenience components of the sample containment valve 20 may be selected from vacuum fittings available under traded names such as VCR a registered trademark of Cajon Company 32550 Old South Miles Road, Solon Ohio 44139 which is affiliated with Swagelok Co. 31400 Aurora Rd. Solon Ohio 44139. The cathode holder 56 is screwed into a VCR female nut 60 and the female nut 60 is in turn screwed to a VCR plug 62. The plug 62 is joined to the forward portion 23 of the valve body 22. Mounted within the female nut 60 is a VCR gland 64. The gland 64 has a sealing surface 66 which is forced against a conical surface 68 on the rear of the cathode holder 56. The gland 64 has a sealing ring 70 on its base 72 which compresses a VCR gasket 74.

The cathode holder 56 has an aperture 76 which forms the gas exhaust 28 and which admits a cesium ion beam from the coaxial ionizer 156 and allows the passage of carbon dioxide gas and the negative ions of carbon and oxygen produced at the titanium cathode 52. The aperture 76 may be coformed with the cathode holder 56 or can be formed by the cesium beam which can be used to drill the aperture by evaporation a portion of the cathode holder 56. The advantage of drilling the aperture 76 with the cesium beam is that the entire sample containment valve 20 may be kept sealed from the time the carbon dioxide sample is loaded until the containment valve 20 is placed within the sample containment vacuum chambers 50 and the chambers have been evacuated. The disadvantage of requiring the cesium ion beam to form the aperture 76 is that it takes approximately one minute for the beam to drill through the cathode holder. In addition, the vaporization of aluminum in the sample containment vacuum chamber may be undesirable.

Extending from the valve body 22 at right angles to the valve body is a short length of tube 78 which forms a cold finger 80. As shown in FIG. 1 a dewar 82 containing a quantity of liquid nitrogen 84 may be positioned so the cold finger 80 extends through an insulating cap 81 into the cryogenic liquid 84. The dewar 82 in FIG. 1 is shown for illustrative purposes and is only used with the sample containment valve 20 when a gas sample is being loaded into the storage volume 24. When the valve 20 is connected to a source of carbon dioxide such as a sample combuster, carbon dioxide gas is cryo-pumped into the interior 86 of the cold finger 80 where it forms frozen carbon dioxide or dry ice 83.

Samples of carbon dioxide are formed from small samples of organic matter. The organic matter in the sample is combusted in a sealed container by heating the sample in the presence of pure oxygen in a manner not dissimilar to that used in a calorimetric bomb. The gas thus formed may be purified by the use of filters and cold traps.

The sample containment valve 20 is constructed of 316L stainless steel. During manufacturing all parts used to construct the sample containment valve 20 are out-gassed at a temperature of 600 degrees C. for 15 minutes under a vacuum of $10^{-7}$ torr. For preparation of the sample containment valve 20 for shipment or storage the valve is baked to 150 degrees C. under a vacuum of $10^{-7}$ torr and the storage volume 24 of the valve 20 is back filled with argon (at a pressure of 15 psi) and evacuated three times while at a temperature of 150 degrees C. Finally, the storage volume 24 of the valve 20 is back filled with 15 psi of argon and the valve 20 is closed by seating the valve-seat 32 against the valve-stem 30 by turning the valve handle 44. After closing the valve 31 a blind VCR female nut (not shown) and a new gasket 74 are used to seal the end of the VCR plug 62.

To transfer a sample into the containment valve the blind female VCR nut (not shown) is removed. A gland (similar to the gland 64 shown in FIG. 1) has an extension for connecting the sample containment valve 20 to a manifold from which a gas sample is received. When the sample containment valve 20 is connected to the manifold the passageway 26 and the storage volume 24 are evacuated. Next the cold finger 80 of the valve 20 is placed within liquid nitrogen 84 contained in the dewar 82. The sample containment valve 20 receives a gas sample by cryo-pumping the gas sample into the storage volume 24. When the sample is collected at the cold finger 80 the internal containment valve 31 is closed. The blind female VCR nut (not shown) is reinstalled with a new VCR gasket 74.

To install a titanium cathode 52 the blind female VCR nut is removed and the gland 64 and a new gasket 74 are locked in position by the female VCR nut. The cathode holder 56 containing the titanium cathode 52 is then screwed into the female VCR. All operations in loading and preparing the sample containment valve 20 should be performed under an argon hood. The valve 20 may be reused many times. However, the titanium cathode becomes contaminated with a given sample and must be replaced with each new sample.

The cathode holder 56 has a 0.4 to 0.5 mm aperture 76 which forms the gas exhaust 28 and allows the entrance of a cesium ion beam. The aperture may be formed by eroding a hole with the concentrated ion beam or the aperture may be pre-drilled. The aluminum cathode holder 56 is shaped so that the flow of gas from the reservoir of the sample containment valve 20 passes over the front surface of the titanium cathode 52. The front surface of the titanium cathode 52 is activated by eroding off the oxide there by impacting the front surface of the cathode 52 with the cesium ion beam. Removal of the oxide there produces a surface which is an efficient getter of carbon dioxide gas. The shape of the titanium cathode 52 is that of a cylinder which has opposed flats formed on the cylindrical sides. The shape of the titanium cathode 52 is substantially the same as described in A Gaseous Ion Source For Routine AMS RadioCarbon Dating by C. R. Bronk and R. E. M. Hedges, Nuclear Instruments And Methods In Physics Research B52 (1990) 322–326 North-Holland.

To use the valve it is installed on the carousel 88 along with other samples of containment valves 20 and the carousel 88 is placed within the vacuum chamber 50 adjacent to the ion source 90 as shown in FIG. 3.

The sample chamber 50 is then pumped down to high vacuum and the gate valve 92 between the chamber 50 and the ion source 90 is opened. As shown in FIGS. 4 and 5 the entire sample containment assembly 94 is movable towards the ion source 90, so the ion source 90 moves towards the heating shield 58 in the sample chamber 50. Individual sample containment valves 20 are positioned by movement of an engaged shaft 146 by 1⅛ inches towards the heat sink 59. In a conventional sample presentation system using a carrousel, which is known for solid samples, the need for a gate-valve between the sample vacuum chamber and the ion source results in a need to move the sample towards the ion source by approximately four or five inches. This amount of movement is difficult to achieve with a gas sample container without a complicated mechanism which, for example, would remove the sample container from the carrousel. Thus by reducing the amount of motion needed to position the sample containment valve 20, the means for positioning the valve 20 is simplified and the valve 20 can remain attached to the carrousel 88.

Each sample containment valve 20 is mounted in one of forty openings 100 in the carousel 88. As shown in FIG. 1 where a portion of the carousel 88 is shown holding a sample containment valve 20, the valve is positioned in a opening 100. A spring 102 is mounted about the rear portion 48 of the valve 22 and is captured between the carrousel 88 and a retaining fitting 89, which with the retaining ring 106, holds the sample containment valves 20 on to the carousel 88. The arrangement on the sample containment valve on the carousel 88 allows the valve 20 to move parallel to the axis 104 of the carousel 88 so it can be moved towards and away from the ion source 90.

The entire chamber 50, including everything to the right of the bellows joint 108, in FIGS. 3–5 is mounted for translation parallel to the axis 104 of the carousel 88. The chamber is mounted on linear bearings which slide on rails. Positioned between the bellows joint 108 and the chamber 50 is a gate valve 92. Movement of the entire chamber 50 towards and away from the ion source 90 allows the gate 91 of a gate-valve 92 to be positioned between the vacuum chamber 50 and the ion source 90. It is necessary to isolate the sample vacuum chamber 50 from the ion source 90 because the ion source communicates with the tandem accelerator which employs an evacuated acceleration tube. The sample chamber 50 may be isolated from the tandem accelerator without increasing the distance the sample containment valves 20 must be moved to bring it into engagement with the ion source 90.

A gate valve is necessary so sample containment valves 20 may be loaded and unloaded from the chamber 50 and the carousel 88. A removable hatch 110 provides access to the chamber 50. A view port 112 allows viewing of the movement of a sample containment valve 20 into and out of engagement with the heat-sink 59.

In order to bring a sample containment valve 20 into engagement with the cathode heat sink, the carousel is rotated to bring a selective valve 20 to a position behind the heat sink. When in position the valve 20 is pushed forward by the engagement shaft 146 and the valve handle 44 is turned in order to start the flow of gas. The performance of these operations is complicated by the fact that the sample containment valves 20 and the entire sample containment chamber 50 are maintained at high vacuum and at a potential of 70,000 volts.

As shown in FIG. 3 two shafts are needed to control the motion of the sample containment valve 20. A first shaft 114 is mounted to the carousel 88 through a beating incorporating a ferromagnetic fluid seal 116. The shaft 114 is constructed of plexiglass and mounted to a plexiglass support 118. The shaft 114 is driven by a motor 120 and the motor is linked by a chain drive 122 to a shaft encoder. The motor rotates the carousel 88 to position one of forty sample containment valves 20 beneath the ion source 90. The shaft encoder 124 is used to control the position of the carousel 88 by using a feedback loop to control the motor 120. An indexing disk 126 is mounted on the shaft 114 and an indexing pin 130 is moved by a solenoid or air piston 128 and is used to positively position the carousel 88 by moving the pin 130 into an indexing hole 132 in the indexing disk 126.

The second shaft 134 is constructed of plexiglass and is driven by a second motor 136. The second shaft 134 drives a shaft 138 on which is slidably engaged a movable extension 140. The extension 140 forms a ferromagnetic bearing 142 which provides a vacuum seal about the extension 140. The bearing 142 is mounted to an extensible bellows joint 144. Mounted to the extension 140 is an engagement shaft 146. The engagement shaft 146 terminates in a universal socket 147 shown in FIG. 5 which engages the valve handle 44. The universal socket 147 allows for slight misalignment in the engagement of the engagement shaft 146 with a hex socket 148 forming part of the valve handle 44. The engagement shaft 146 and the extension 140 is moved by three air pistons 150, one of which is shown in FIG. 3. The air pistons 150 are mounted at 120 degree intervals about the extension 140.

It is very important that the positioning of the sample containment valves be extremely reliable because of the loss of productive time if a sample container 20 becomes jammed requiring the vacuum chamber to be opened. In prior art devices for presenting solid carbon samples to an ion source, positioning the solid sample is as critical yet, a movement of four or five inches to position a solid sample has been used. A solid sample carousel which employs movement of the sample and movement of the vacuum chamber as illustrated herein would be advantageous. In operation, the $C^{14}$ age dating processes employing the sample containment valve 20 involve the following steps. Sample containment valves 20 are supplied to the experimenter who loads the valves 20 with carbon dioxide samples. The containment valves 20 are shipped to a tandem accelerator facility where the samples are mounted on a carousel 88 along with controls of known age. The carousel with forty samples is then loaded into the sample vacuum chamber.

The chamber 50 is evacuated and the gate-valve 92 is opened whereupon the chamber 50 is slid towards the ion source 90 until the cathode heat shield 58 is positioned beneath the ion source. The carousel 88 is rotated until a selected sample contained in a valve 20 is positioned behind the heat sink 59. The carousel 88 is locked in position by the air cylinder pin 128 engaging an indexing hole in the indexing disk 126. The air pistons 150 move the extension 140 and the engagement shaft 146 forward until the shaft 146 and the universal driver mounted thereon engage the valve handle 44. The second motor 136 then drives the second shaft 134 which turns the valve handle 44 opening the valve 31 by allowing the valve seat 32 to disengage from the valve stem 30 initiating a flow of gas through the passageway 26 and out the gas exhaust 28. The flow of gas is precisely controlled by decompressing the stacked Belleville washers which in turn very gradually backs off on the force holding the valve-seat 32 against the valve stem 30 and controls the amount of gas, on the order of $10^{-10}$ torr liters per minute, which is allowed to pass through the valve. A cesium ion beam is now directed through the cathode holder aperture 28 to bombard the titanium cathode 52.

The storage volume of the sample containment valve 20 is about 1.5 cc. At one atmosphere 1.5 cc is about 3 mg of carbon dioxide or about 0.8 mg carbon. Therefore, for a sample of one mg of carbon the pressure of the gas at standard temperature would be about 1¼ atmospheres. As the valve is opened, the gas passes by the unoxidized titanium which acts as a getter absorbing the carbon dioxide on the surface of the titanium. The cesium ion beam causes a sputtering effect which produces negative ions of carbon and oxygen.

The basic design of the cesium sputtered ion source 90 is conventional and essentially similar to the high intensity sources used in many applications. It has a chamber 152 filled with cesium vapor in which there is a coil 154 and a tantalum coaxial ionizer 156. The cesium beam from the ionizer 156 is focused onto the titanium cathode 52 which acts as a negative ion source. Carbon dioxide gas is passed over and absorbed onto the titanium cathode 52. Sputtering by the cesium beam generates negative ions of carbon and oxygen. Overall efficiencies of a few percent are routinely achieved with the use of a tandem accelerator. Conventional radioactive decay sample counting permits about 3 atoms per million of $^{14}C$ atoms in a sample to be detected in one week. In contrast, a tandem accelerator mass spectrometer enables approximately 2½ percent or 25,000 atoms per million present in the sample, often, in a time interval of less than one hour. The increased sensitivity by a factor of over a thousand can be used to reduce the size of the sample required for the measurement and also offers the possibility of dating samples which are of greater age.

Figure 7:
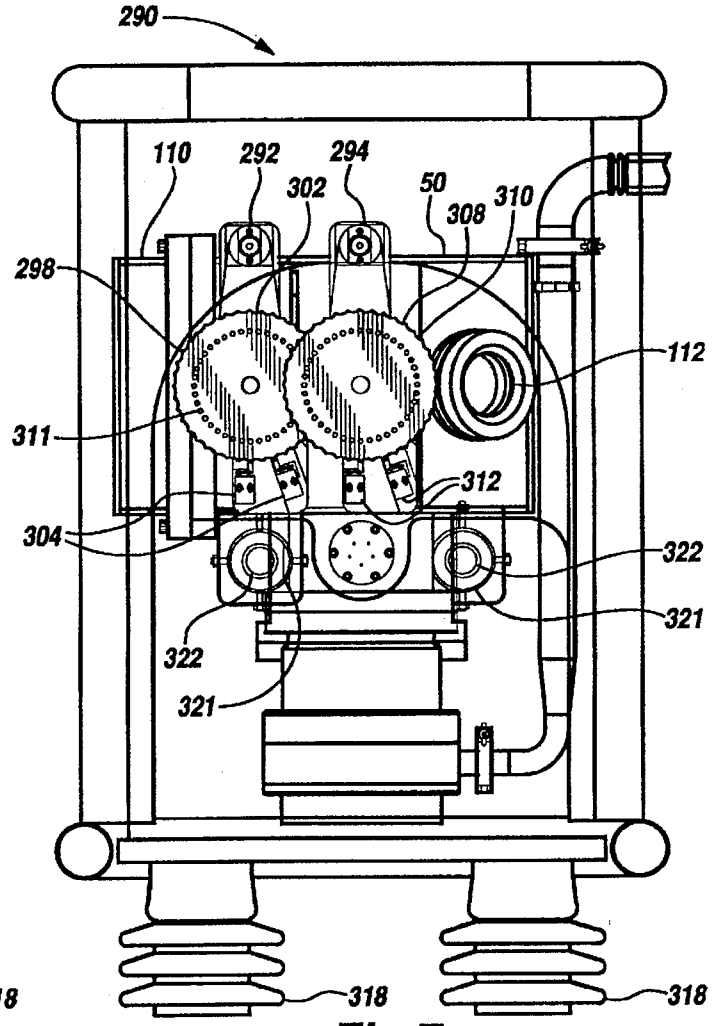
FIG. 7 is a front elevational view of the apparatus of FIG. 6.
Figure 6:
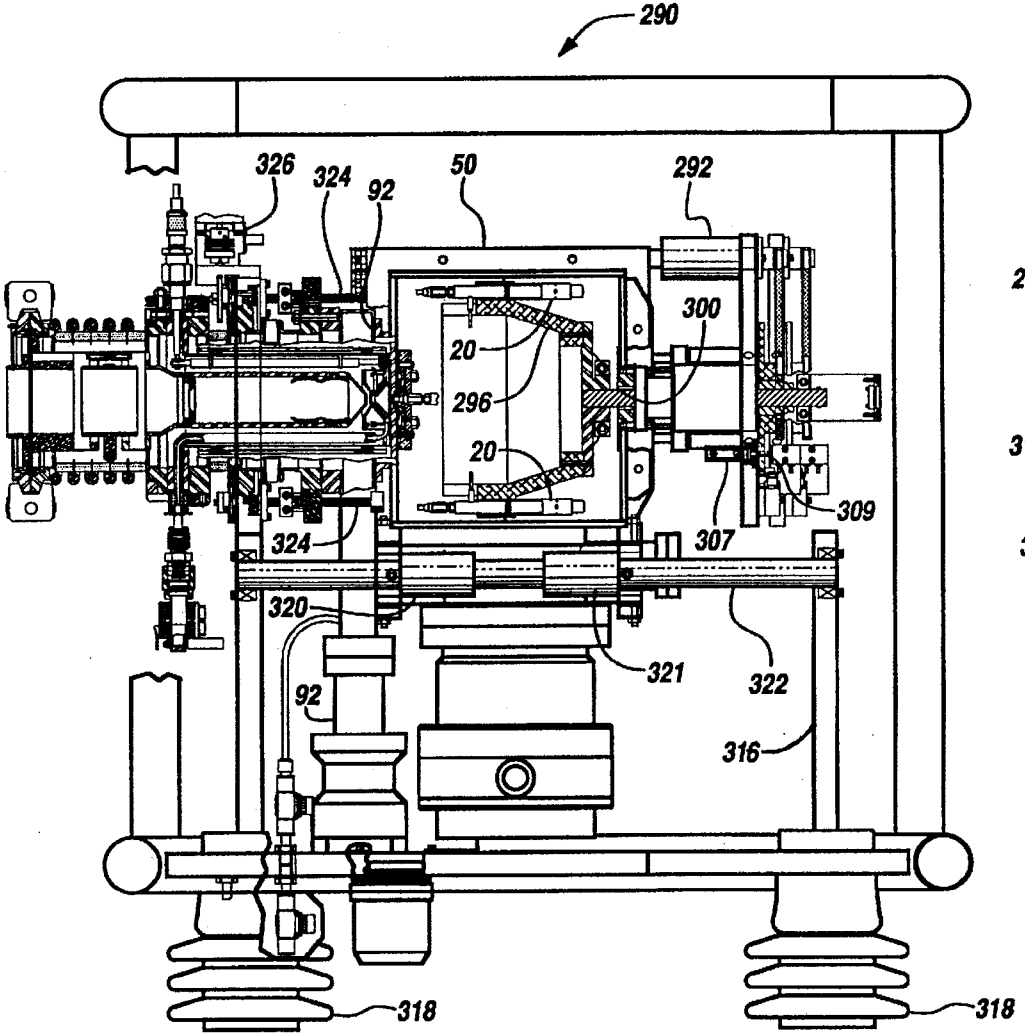
FIG. 6 is a side elevational view, partially broken away in section, of an alternative embodiment sample carousel and sample vacuum container of this invention.

An alternative embodiment ion source 290 is shown in FIGS. 6 and 7. The ion source 290 achieves greater compactness by employing an air motor 292 to rotate the carrousel 296, and an air motor 294 to rotate the valve handle 44 on the sample containment valves 20. An indexing disk 298 is mounted to the carrousel shaft 300. The indexing disk 298 has teeth 302 around its outer peripheral edge. The teeth 302 actuate an air valve 304 as each tooth 302 moves over center on the air valve 304. This actuation of the air valve 304 provides an indication of the position of the indexing disk 298 which in turn indicates the position of the carrousel 306. The carrousel 306 is precisely positioned by an air cylinder 307 which moves a pin 309 into a indexing hole 311 in an arrangement similar to that shown in FIG. 3. An indexing disk 308 is mounted to an engagement shaft (not shown) which engages and turns the valve handle 44 of the sample containment valves 20 shown in FIG. 6. The indexing disk 308 has teeth 310 which actuate air valve 312 and provide an indication of the position of the engagement shaft (not shown).

Because the ion source 290 is at a potential of about 70,000 volts it is difficult to position sensors and electric motors at such a high potential. The ion source 90 utilizes plexiglass shafts 114, 134 to transmit mechanical motion across the high voltage potential. The ion source 290 provides a more compact design by employing air motors 292 294 and air sensors 312 which can easily be connected across the high potential by insulated supply lines. The ion source 290 is mounted to a frame 316 which is separated from ground by insulators 318. The vacuum chamber 50 of FIGS. 6 and 7 is mounted by beatings 320 and 321 which move on shafts 322.

Motion of the vacuum chamber 50 is controlled by machine screws 324 which are driven by twenty-four volt electric motors 326. The motors 326 can only be connected to a power supply manually when the ion source 290 is at ground potential. The motor 326 and the manually operated gate valve 92 provide a safety feature. Actuation of the gate valve 92 before the chamber 50 has been moved away from the entrance 96 can result in catastrophic destruction of the coaxial ionizer 156. By requiring manual operation of the vacuum chamber drive motors 326 and manual closing of the gate valve 92 the potential for operator error is greatly reduced or eliminated.

It should be understood that gas supply lines can be brought through the carrousel shaft 300 so that gas samples can be supplied by forty gas lines, one going to each sample containment valve 20. This would produce a system which could position one of forty gas manifolds to supply sample gas to the ionizer 154.

It should be understood that the sample containment valve 20 gains an advantage over the prior art by eliminating possible sources of contamination of a gas sample. The sample is handled only once in transferring the carbon dioxide to the storage volume 24 in the valve body 22. The sample containment valve 20 functions as its own manifold and directly supplies gas to a self-contained titanium cathode from which the negative carbon ions are generated by the impinging cesium ion beam.

It should also be understood that because the sample containment valve 20 functions without an external manifold, it facilitates automatic switching between multiple samples which are being analyzed.

It is understood that the invention is not limited to the particular construction and arrangement of parts herein illustrated and described, but embraces such modified forms thereof as come within the scope of the following claims.

I claim:

1. An apparatus having a gas sample container and valve for providing gas to an ion source, comprising:

a valve body having portions defining a gas storage volume;

a valve stem mounted to the valve body, the valve stem having portions defining a passageway for releasing gas from the storage volume;

a valve seat moved with respect to the valve body, wherein the valve seat is moved away from the valve stem to permit a flow of said gas from the storage volume to the passageway in the valve stem, and wherein the valve seat is moved towards the valve stem to block the flow of said gas from the storage volume to the valve stem passageway;

a first spring having a first spring constant and located within the valve body and biasing the valve seat away from the valve stem;

a second spring having a second spring constant and providing a spring force for biasing the valve seat towards the valve stem, wherein the second spring constant is less than one half the first spring constant; and a screw mounted to the valve body, the second spring positioned between the screw and the valve seat, the screw positioned to move towards and away from the second spring, to adjust the spring force to open and close the valve seat.

2. The apparatus of claim 1 wherein the spring constant of the second spring is less than one tenth of the spring constant of the first spring.

3. The apparatus of claim 1 wherein the spring constant of the second spring is less than one twentieth of the spring constant of the first spring.

4. The apparatus of claim 1 wherein the first spring and the second spring are composed of identical Belleville springs in stacked array and wherein the second spring is composed of at least twice as many Belleville springs in stacked array as the first spring.

5. The apparatus of claim 1 wherein the first spring and the second spring are composed of identical Belleville springs in stacked array and wherein the second spring is composed of at least ten times as many Belleville springs in stacked array as the first spring.

6. The apparatus of claim 1 wherein the first spring is composed of a pair of opposed Belleville springs and wherein the second spring is composed of about 25 pairs of substantially identical Belleville springs.

7. The apparatus of claim 1 further comprising:

a thermally conductive extension mounted to the valve body;

portions of the extension which define an internal volume connected to the gas storage volume, wherein the extension extends into a cryogenic container containing a quantity of liquefied cryogenic gas, such that a quantity of carbon dioxide is cryo-pumped into the extension when the valve is open.

8. The apparatus of claim 1 wherein the first and second springs are Belleville-type springs.

9. The apparatus of claim 1 wherein the valve stem has a seat engaging surface which is a smoothly radiused annulus, and wherein the valve seat has a copper seat forming member which abuts the seat engaging surface of the valve stem when the valve is closed.

10. The apparatus of claim 1 further comprising:

a gas exhaust mounted to the valve body and in communication with the passageway for releasing said gas from the storage volume; and a quantity of titanium metal positioned with respect to the passageway to act as a getter to absorb said gas released from the storage volume to thereby facilitate the production of a negative ion beam of ions from a quantity of said gas stored within the storage volume.

11. The apparatus of claim 1 further comprising:

a plunger slidably mounted to the valve body, the plunger positioned between the valve seat and the second spring, the plunger transmitting the force of the second spring to the valve seat; and a gas type flexible diaphragm disposed between the valve seat and the plunger, the diaphragm sealing the valve seat within the gas storage volume and allowing the transmission of the second spring force between the plunger and the valve seat.

12. The apparatus of claim 1 further comprising:

an aluminum cathode holder;

portions of the holder which define an internal passageway in communication with the passageway of the valve stem, wherein the cathode holder has an aperture for the release of said gas and ions from the gas sample container and valve; and a titanium cathode positioned to partly occlude the internal passageway of the cathode holder so that said gas exiting the storage volume is caused at least in part to impinge upon the titanium cathode before passing through the aperture.

13. The apparatus of claim 1 wherein the valve body is constructed of stainless steel.

14. A method for forming a aperture in a gas sample container and valve for providing gas to an ion source, the sample container and valve comprising:

a valve body having portions defining a gas storage volume;

a valve stem mounted to the valve body, the valve stem having portions defining a passageway for releasing gas from the storage volume;

a valve seat moved with respect to the valve body, wherein the valve seat is moved away from the valve stem to permit a flow of said gas from the storage volume to the passageway in the valve stem, and wherein the valve seat is moved towards the valve stem to block the flow of said gas from the storage volume to the valve stem passageway;

a first spring having a first spring constant and located within the valve body and biasing the valve seat away from the valve stem;

a second spring having a second spring constant and providing a spring force for biasing the valve seat towards the valve stem, wherein the second spring constant is less than one half the first spring constant;

a screw mounted to the valve body, the second spring positioned between the screw and the valve seat, the screw positioned to move towards and away from the second spring, to adjust the spring force to open and close the valve seat;

an aluminum cathode holder;

portions of the holder which define an internal passageway in communication with the passageway of the valve stem, wherein the cathode holder has an aperture for the release of said gas and ions from the gas sample container and valve; and a titanium cathode positioned to partly occlude the internal passageway of the cathode holder so that said gas exiting the storage volume is caused at least in part to impinge upon the titanium cathode before passing through the aperture, the method for forming the aperture comprising the steps of:

focusing an ion beam onto an exterior surface of the cathode holder, said exterior surface being adjacent to the titanium cathode and aligned with the passageway in the cathode holder; and eroding an aperture between the surface and the passageway of the cathode holder with the ion beam.

15. An apparatus having a gas sample container and valve for providing gas to an ion source, comprising:

a valve body having portions defining a gas storage volume;

a valve stem having portions defining a passageway for releasing gas from the storage volume;

a valve mounted on the valve body for releasing said gas from the storage volume through the passageway;

a means extending externally of the valve body and mounted to the valve body for controlling an opening or a closing of the valve; and a titanium cathode mounted to a metal heat sink which is mounted to the valve body so the passageway directs said gas to impinge on the titanium cathode when the valve is opened.

16. The apparatus of claim 15 further comprising:

a thermally conductive extension mounted to the valve body; and portions of the extension which define an internal volume in communication with the gas storage volume, wherein the extension extends into a cryogenic container containing a quantity of liquefied cryogenic gas, so a quantity of carbon dioxide is cryo-pumped into the extension when the valve is open.

17. The apparatus of claim 15 further comprising:

a valve seat moved with respect to the valve body, the valve seat is moved away from a valve stem to open a flow of said gas from the storage volume to the passageway, wherein the valve seat is moved towards the valve stem to block the flow of said gas from the storage volume to the passageway;

a first spring having a first spring constant and located within the valve body and biasing the valve seat away from the valve stem; and a second spring having a second spring constant and providing a spring force for biasing the valve seat towards the valve stem, wherein the second spring constant is less than one half the first spring constant.

18. The apparatus of claim 17 wherein the valve stem has a seat engaging surface which is a smoothly radiused annulus, and wherein the valve seat has a copper seat forming member which abuts the seat engaging surface of the valve stem when the valve is closed.

19. The apparatus of claim 17 further comprising:

a plunger slidably mounted to the valve body and positioned between the valve seat and the second spring, wherein the plunger transmits the force of the second spring to the valve seat; and a gas type flexible diaphragm disposed between the valve seat and the plunger, the diaphragm sealing the valve seat within the gas storage volume and allowing the transmission of the second spring force between the plunger and the valve seat.

20. The apparatus of claim 15 wherein the metal heat sink comprises an aluminum cathode holder having portions defining an internal passageway in communication with the valve body passageway, and wherein the cathode holder has portions defining an aperture for the release of said gas and ions from the gas sample container and valve, and wherein the titanium cathode is positioned to partly occlude the passageway of the cathode holder so that said gas exiting the storage volume is caused at least in part to impinge upon the titanium cathode before passing through the aperture.

21. The apparatus of claim 15 wherein the valve body is constructed of stainless steel.

22. A method for forming a aperture in a gas sample container and valve for providing gas to an ion source, the sample container and valve comprising:

a valve body having portions defining a gas storage volume;

a valve stem having portions defining a passageway for releasing gas from the storage volume;

a valve mounted on the valve body for releasing said gas from the storage volume through the passageway;

a means extending externally of the valve body and mounted to the valve body for controlling an opening or a closing of the valve; and a titanium cathode mounted to a metal heat sink which is mounted to the valve body so the passageway directs said gas to impinge on the titanium cathode when the valve is opened, wherein the metal heat sink comprises an aluminum cathode holder having portions defining an internal passageway in communication with the valve body passageway, and wherein the cathode holder has portions defining an aperture for the release of said gas and ions from the gas sample container and valve, and wherein the titanium cathode is positioned to partly occlude the passageway of the cathode holder so that said gas exiting the storage volume is caused at least in part to impinge upon the titanium cathode before passing through the aperture; the method for forming the aperture comprising the steps of:

focusing an ion beam onto an exterior surface of the cathode holder, said exterior surface being adjacent to the titanium cathode and aligned with the passageway in the cathode holder; and eroding an aperture between the surface and the passageway of the cathode holder with the ion beam.

23. An apparatus for generating ions from a gas sample for a tandem accelerator comprising:

an evacuated chamber;

an ionizer for producing ions from a sample in communication with the evacuated chamber;

an extendible housing, within which the ionizer is mounted, wherein the housing is extended to an extended position, and retracted to a retracted position;

a vacuum chamber mounted to the housing and communicating with the housing, the vacuum chamber for storage of samples, wherein the vacuum chamber is slidably mounted with respect to the ionizer, and wherein the ionizer abuts the vacuum chamber when the housing is in the retracted position;

a carousel mounted for rotation within the vacuum chamber;

a multiplicity of samples mounted on the carousel; and a valve which is mounted to the housing and which is operated to selectably separate the vacuum chamber from the ionizer, such that when the housing is in the extended position, the valve is closed to separate the vacuum chamber from the ionizer to thereby isolate the sample chamber from the tandem accelerator.

24. The apparatus of claim 23 wherein the valve is a gate-valve.

* * * * *